US007446249B2

(12) United States Patent
Driscoll

(10) Patent No.: US 7,446,249 B2
(45) Date of Patent: Nov. 4, 2008

(54) SUPPORT FOR MUSICAL INSTRUMENT

(75) Inventor: Robert Donald Driscoll, Winnipeg (CA)

(73) Assignee: Joan Driscoll, Winnipeg, Manitoba (CA), part interest ( * ) Notice: Subject to any disclaimer, the term of this patent is extended or adjusted under 35 U.S.C. 154(b) by 0 days.

(21) Appl. No.: 11/733,810

(22) Filed: Apr. 11, 2007

(65) Prior Publication Data

US 2008/0028913 A1 Feb. 7, 2008

Related U.S. Application Data

(60) Provisional application No. 60/820,966, filed on Aug. 1, 2006.

(51) Int. Cl.
*G10D 3/00* (2006.01)

(52) U.S. Cl. ..... 84/327

(58) Field of Classification Search ..... 84/290, 84/327, 329

See application file for complete search history.

(56) References Cited

U.S. PATENT DOCUMENTS

| | | | | |
|---|---|---|---|---|
| 4,991,809 | A * | 2/1991 | Harkey | 248/229.12 |
| 5,346,073 | A | 9/1994 | Broersma | |
| 6,130,375 | A | 10/2000 | Kellogg | |
| 2005/0000348 | A1 * | 1/2005 | Workman | 84/327 |

* cited by examiner

*Primary Examiner*—Kimberly R Lockett
(74) *Attorney, Agent, or Firm*—Adrian D. Battison; Ade & Company Inc.

(57) ABSTRACT

A support for a musical Instrument manufactured from a firm yet pliable material which is slid under the supporting handle of an amplification device or slid between two stacked amplification devices by a finger hole at one end. The fingerboard or neck of a musical instrument, when stood upright on the floor, can be inserted into a socket on the other end of the device providing support when the instrument is not being played and providing a convenient and safe means of storage when the instrument is not in use. Two gear-shaped ends assist in sliding the device under the handle of the amplification device and the two slots by the socket hold guitar plectrums.

11 Claims, 4 Drawing Sheets

15
16
18
20
21
24
25
26
27
28
4
5
1
20
21A
Q

SUPPORT FOR MUSICAL INSTRUMENT

This application claims the benefit under 35 U.S.C. 119 of the filing date of Provisional Application Ser. No: 60/820,966, filed Aug. 1, 2006.

This invention relates to a support for a musical instrument for supporting the musical instrument in a standing position when not in use.

BACKGROUND OF THE INVENTION

This invention has particular but not exclusive application to providing support and stability to musical instruments by way of leaning the instruments into or against the support which is positioned on top of an amplification device and secured to a rigid and stable position by the handle of the amplification device.

Many musicians who use stringed instruments, and particularly those who play guitar and perform live, require a way of supporting their instrument while they are not playing it. This has been achieved by way of the standard guitar stand, however there are several disadvantages related to the standard guitar stand. They are unstable, awkward to transport and set up, and take up space on stage.

The problems with traditional guitar stands are discussed in U.S. Pat. No. 6,130,375 (Kellogg) issued Oct. 10, 2000 however this patent discloses a solution by the way of a stand for attachment to the base of a guitar which is not satisfactory.

Published US patent application 2005/0000348 (Workman) published Jan. 6, 2005 discloses a clip which is adhesively attached to the side of an amplifier and provides a receptacle for the neck of the guitar. This application has been abandoned.

U.S. Pat. No. 5,346,073 (Broersma) published Sep. 13, 1994 discloses a weighted plate which rests on the top of an amplifier and provides a receptacle for the neck of the guitar.

SUMMARY OF THE INVENTION

It is one object of the invention to provide a support for a musical instrument which can be used in combination with an amplifier unit.

According to one aspect of the invention there is provided a support for a musical instrument comprising:

a generally planar body formed of a flexible material;

on one end of the body is provided a receptacle for the neck of a musical instrument;

on the other end of the body the end and corners are shaped for insertion of the other end under the handle of an amplifier unit;

the body having sufficient length from the handle to the receptacle to present the receptacle over the front edge of the amplifier unit for receiving the instrument standing along the front.

According to a second aspect of the invention there is provided a support for an upright musical instrument comprising:

an amplifier unit having a box shaped housing with a top handle strap;

a support having a generally planar body formed of a flexible material;

on one end of the body is provided a receptacle for the neck of a musical instrument;

the other end of the body is arranged for insertion of the other end under the handle of the amplifier unit;

the body having sufficient length from the handle to the receptacle to present the receptacle over the front edge of the amplifier unit for receiving the instrument standing along the front so that the instrument is safely held by the support in an upright position.

The present invention also aims to alleviate the above situations and provide a support apparatus which will be reliable, safe, stable, convenient and efficient in use.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figures 1, 2, 3, 4:
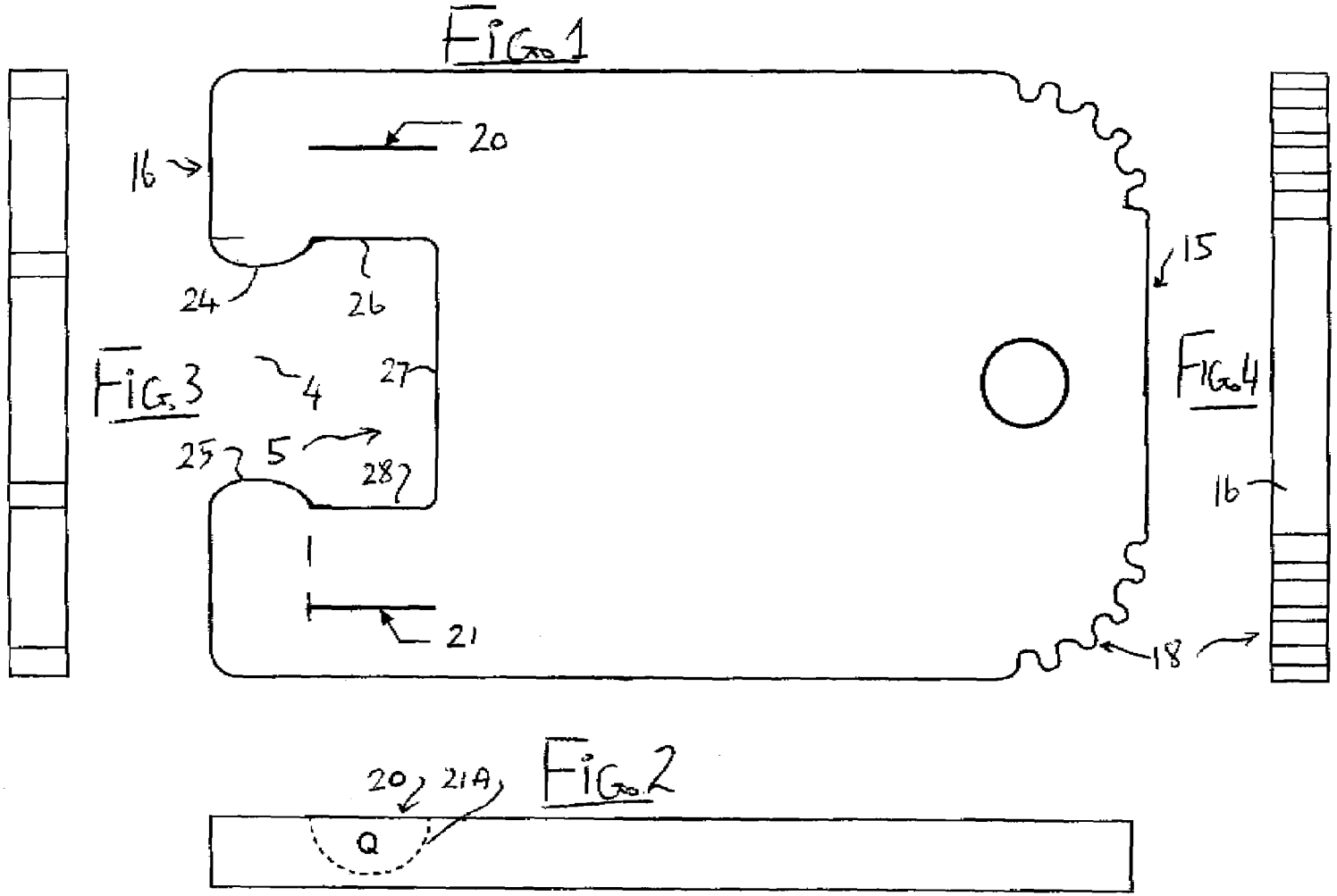
FIG. 1 is a top plan view of the support according to the present invention.
FIGS. 2, 3 and 4 are side and end views of the support of FIG. 1.
Figure 5:
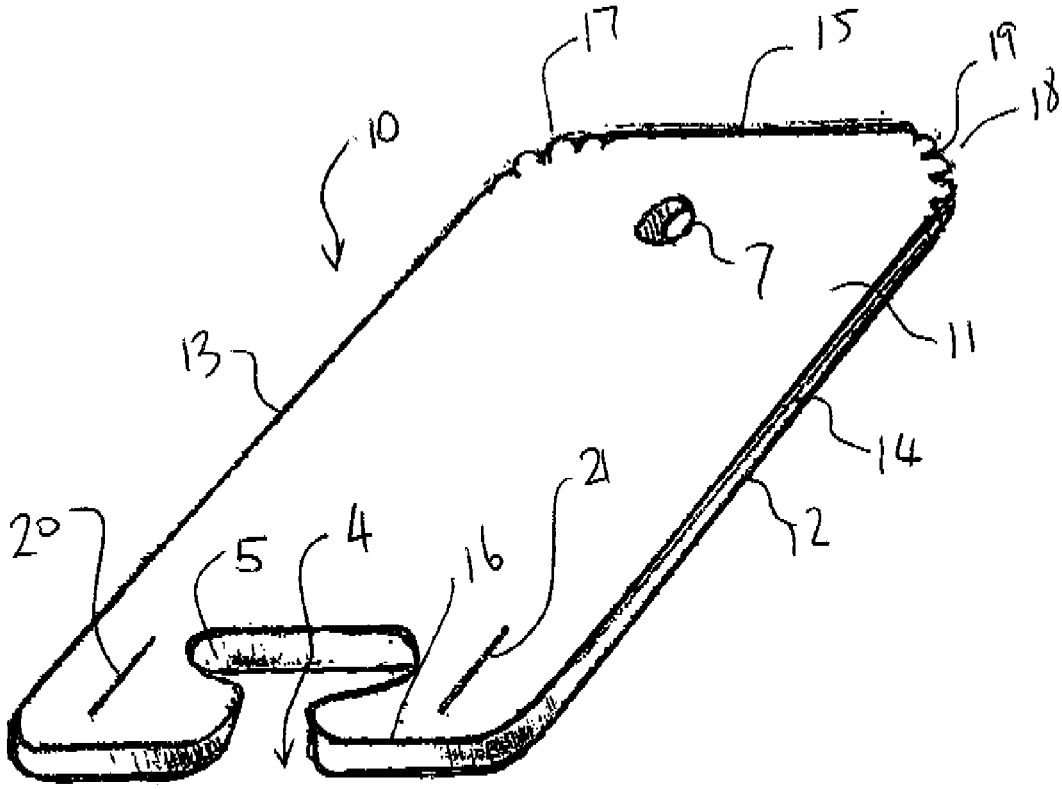
FIG. 5 is an isometric view of the support of FIG. 1.

With respect to FIGS. 1 and 5, of the drawings, a support 10 of the present invention comprises a generally planar body, having a top flat surface 11, planar base 12 and sides 13 and 14 and ends 15 and 16 forming a generally flat rectangular body.

At the end 16 is provided an opening 4 leading to a socket 5 within the body which is wider and deeper than the opening. The opening is defined by two sides 24 and 25 facing inwardly toward one another which are smoothly curved. The socket or receptacle opens out into a generally rectangular area with three sides 27, 28 and 29 each connected to the next by a curved corner so as to avoid stress tearing at the corners. The connection to the faces 24 and 25 is also smoothly curved in a concave direction to provide a smooth connection to the convex faces 24 and 25.

At the other end 15, the body is shaped at the corners 17 and 18 to provide a generally rounded corner with notches 19 extending into the body which form in effect gear-shaped corners for easier insertion into an opening as described hereinafter. Between the corners and spaced from the end into the body is provided a finger pull hole 7 which extends through the body.

The body 1 is molded in a firm pliable material capable of allowing the insertion and removal of an elongate limb of a musical instrument into and from the socket 5 to provide support arid safety for same.

The support is primarily designed for use with a range of musical instruments and as such the opening 4 to the socket is ideally 40 mm wide and 40 mm deep.

The opening 4 to the socket 5 is provided with the curved surfaces 24 and 25. The curved surfaces on the surfaces facing inwardly of the opening towards one another, allows the neck to slip through into the socket.

The shape of the socket is preferably rectangle and straight edged and therefore complementary to the fret board of the neck of most forms of stringed instruments facing inward to avoid bending of the instruments neck. All of the corners of the generally rectangular socket are curved to reduce stress at the corners which can promote tearing of the foam material when stretched to receive the neck.

The flat top surface of the support on each side of the socket is provided with slits 20, 21 extending partly through the support to accommodate guitar plectrums. The slits are formed in the top surface and preferably do not extend through the full thickness to avoid a potential tearing opportunity. As shown in FIG. 2 the slit 20 is formed with a curved bottom edge 21A spaced from the bottom surface of the body.

The support body Is preferably molded from EVA closed cell foam rubber.

In use the fret board of the neck of a musical instrument, such as a guitar is engaged with the socket of the support and the guitar is then conveniently held stable and safe when not in use.

Figure 6:
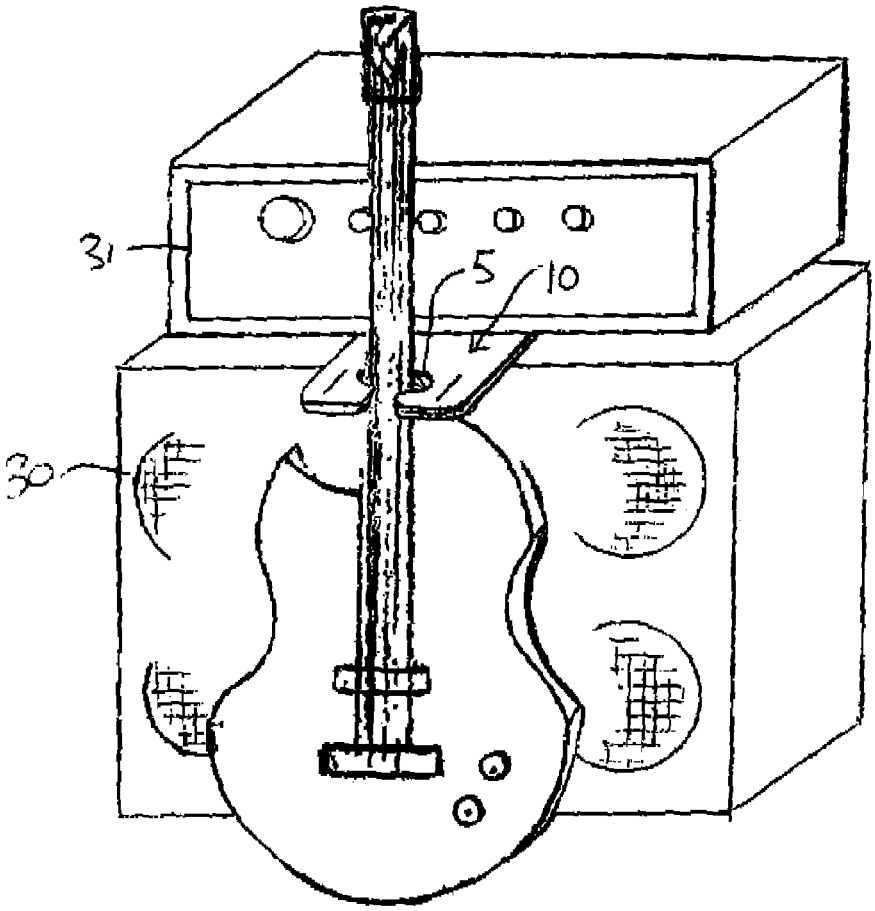
FIGS. 6 and 7 are views of the support of FIG. 1 in use with an instrument.

As shown in FIG. 6, the support 10 can be inserted in horizontal position between two amplifier units 30 and 31 with the socket 5 projecting forwardly from the front face of the units to receive the guitar. The support being relatively thin and flat and formed of a flexible foam can simply be inserted and be held between the units without interfering with their stacking.

Figure 7:
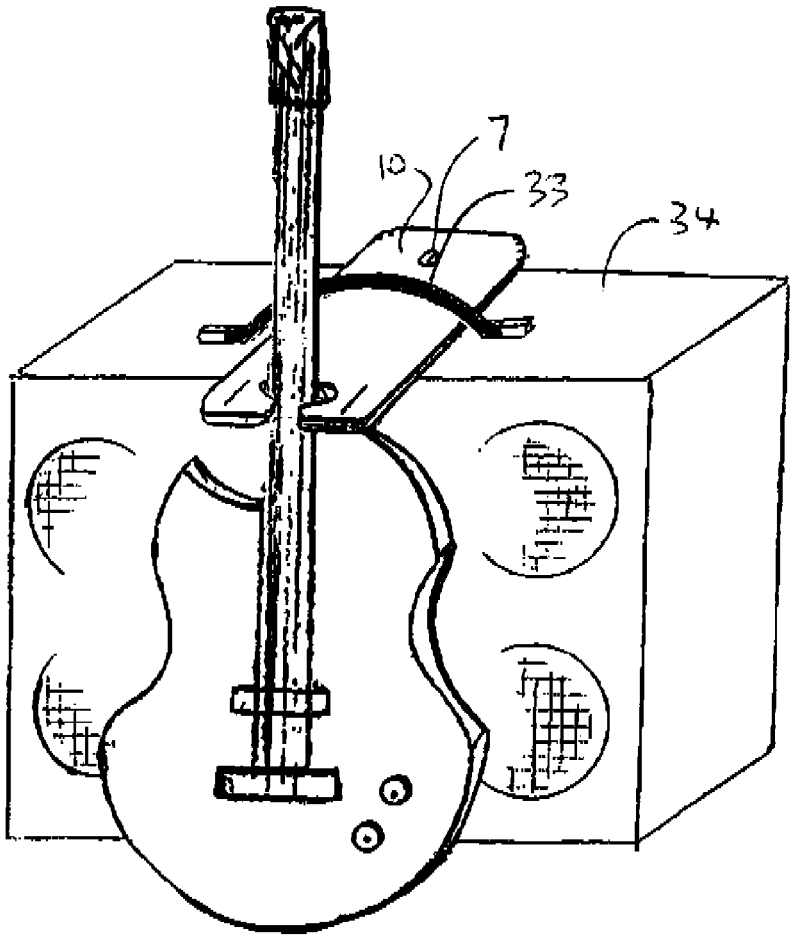

In FIG. 7 the support is located so that its body lies underneath the conventional handle strap 33 on top of the amplifier unit 34. The two gear-shaped corners 17 and 18 allow for easy insertion under the amplification device handle which is then pushed down to help hold the support. The finger hole 7 allows for ease in pulling under the amplification device handle. The body is molded from a stiff and yet pliable material allowing insertion and removal of a limb of a musical instrument into and from the socket holding it firmly in place allowing no damage to the instrument. The material is sufficiently stiff to support the instrument and its weight leaning toward the amplifier away form the amplifier without significant distortion.

Thus the arrangement described herein provides a support for a musical instrument having a body having a planar base. On one end there is an opening leading to an internal socket with two slots. On the other end there are two "gear" shaped corners for easy insertion under an amplification device handle which is then pushed down to hold the support and a finger hole for ease in pulling under the amplification device handle. The body is molded from a firm or stiff yet pliable material allowing insertion and removal of the neck of a musical instrument into and from the socket holding it firmly and safely in place allowing no damage to the instrument.

One example of the support may also have the following features:

Width of the opening to the socket is approximately 40 mm.

The support is approximately 290 mm long and 120 mm wide and 12 mm thick.

The corners are gear-shaped.

The socket area has the slits.

The end with the gear-shaped corners has a finger hole situated in the centre of the support.

The body is molded from ethylene vinyl acetate co-polymer closed cell foam rubber.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A support for a musical instrument comprising:

a generally planar body formed of a flexible material;

on one end of the body is provided a recess defining a receptacle for the neck of a musical instrument;

on the other end of the body the end and corners are shaped for insertion of the other end under the handle of an amplifier unit;

the body having sufficient length from the handle to the receptacle to present the receptacle over the front edge of the amplifier unit for receiving the instrument standing along the front;

wherein there is provided a pair of slots one on each side of the receptacle.

2. The support as claimed in claim 1 wherein the receptacle comprises an opening leading to an internal socket which is wider than the opening.

3. The support as claimed in claim 1 wherein the other end has two gear-shaped corners for easy insertion under a amplification device handle.

4. A support for a musical instrument comprising:

a generally planar body formed of a flexible material;

on one end of the body is provided a recess defining a receptacle for the neck of a musical instrument;

on the other end of the body the end and corners are shaped for insertion of the other end under the handle of an amplifier unit;

the body having sufficient length from the handle to the receptacle to present the receptacle over the front edge of the amplifier unit for receiving the instrument standing along the front;

wherein there is provided a finger hole through the body at the other end for ease in pulling under the handle of the amplifier unit.

5. The support as claimed in claim 1 wherein the body is molded from a stiff and pliable foam material allowing insertion and removal of a neck of a musical instrument into and from the receptacle holding it firmly in place allowing no damage to the instrument while supporting the instrument at a position spaced from the other end at the amplifier unit.

6. The support as claimed in claim 1 wherein a width of the opening to the receptacle is approximately 40 mm.

7. The support as claimed in claim 1 wherein surfaces of the body at the receptacle are curved to avoid tearing.

8. The support as claimed in claim 1 wherein the support is approximately 290 mm long and 120 mm wide and 12 mm thick.

9. The support as claimed in claim 4 wherein the finger hole is of the order of 17 mm in diameter.

10. The support as claimed in claim 1 wherein the body is molded from ethylene vinyl acetate co-polymer closed cell foam rubber.

11. A support for an upright musical instrument comprising:

an amplifier unit having a box shaped housing with a top handle strap;

a support member having a generally planar body formed of a flexible sheet of foam material;

a front end of the body having a receptacle formed into an edge of the sheet of foam material for the neck of a musical instrument;

a rear end of the body having a width across the sheet of foam material so that it is received under the handle of the amplifier unit and so that the sheet of foam material is held in place under the handle by engagement with the handle;

the body having sufficient length from the handle to the receptacle to present the receptacle over the front edge of the amplifier unit for receiving the instrument standing along the front so that the instrument is safely held by the support in an upright position.

* * * * *